United States Patent [19]

Kolakowski et al.

[11] Patent Number: 4,969,506

[45] Date of Patent: Nov. 13, 1990

[54] METHOD FOR SEQUENCE CASTING OF STEEL STRIP

[75] Inventors: Manfred Kolakowski; Günter Flemming; Hans Streubel, all of Erkrath, Fed. Rep. of Germany

[73] Assignee: SMS Schloemann-Siegman Aktiengesellschaft, Dusseldorf, Fed. Rep. of Germany

[21] Appl. No.: 297,846

[22] Filed: Jan. 17, 1989

[30] Foreign Application Priority Data

Jan. 23, 1988 [DE] Fed. Rep. of Germany ..... 3801932

[51] Int. Cl.[5] ..... B22D 11/00

[52] U.S. Cl. ..... 164/459; 164/483

[58] Field of Search ..... 164/418, 459, 461, 483

[56] References Cited

U.S. PATENT DOCUMENTS

| | | | |
|---|---|---|---|
| 4,250,945 | 2/1981 | Koshikawa et al. | 164/461 |
| 4,269,257 | 5/1981 | Ohzu et al. | 164/461 |
| 4,716,954 | 1/1988 | Ardito et al. | 164/461 |
| 4,729,420 | 3/1988 | Flemming et al. | 164/483 |
| 4,730,660 | 3/1988 | Tinnes et al. | 164/483 |
| 4,770,230 | 9/1988 | Tinnes et al. | 164/483 |
| 4,787,438 | 11/1988 | Flemming et al. | 164/483 |
| 4,811,779 | 3/1989 | Streubel et al. | 164/459 |

FOREIGN PATENT DOCUMENTS

| | | | |
|---|---|---|---|
| 2802039 | 8/1978 | Fed. Rep. of Germany | 164/459 |
| 114434 | 9/1979 | Japan | 164/459 |
| 25256 | 2/1982 | Japan | 164/461 |

*Primary Examiner*—Richard K. Seidel
*Assistant Examiner*—Edward Brown
*Attorney, Agent, or Firm*—Wolf, Greenfield & Sacks

[57] ABSTRACT

A method for the sequential casting of steel strip in steel strip casting equipment wherein under normal operating conditions a steel melt is fed through a pouring tube having discharge ports into the pouring area of a cooled ingot mold at a location below the surface of the melt in the mold and is thereafter removed from the mold in the form of steel strip by the combined operation of mold oscillation means and strip discharge means. After the feed of melt is interrupted, anchoring rods are partially longitudinally immersed into the melt laterally of the pouring area of the mold, and the surface of the melt in the mold is lowered to a level below the pouring area. After a desired interval, the melt feed is continued, and the level of the surface of the melt in the mold is allowed to rise above the discharge ports of the pouring tube. Thereafter, casting flux is applied to the surface of the melt, and the operation of the mold oscillation means and the strip discharge means is resumed. The method also includes the steps of restarting the feed of melt through the pouring tube after a desired interval; allowing the level of the melt in the cavity of the mold to rise above the discharge opening of the pouring tube; thereafter applying a layer of casting flux to the surface of the melt in the mold; and restarting the strip discharge means and the mold oscillation means such that the original level of melt in the cavity in the mold is reestablished and maintained.

7 Claims, 2 Drawing Sheets

METHOD FOR SEQUENCE CASTING OF STEEL STRIP

BACKGROUND

I. Field of the Invention

The present invention relates to the casting of steel strip. More particularly, the invention relates to a method and apparatus for the sequence casting of steel strip without the need for a new casting start.

II. Summary of the Prior Art

In the continuous casting of steel, interruptions of the casting operation are sometimes required. For example, wear of the pouring tubes, stoppers and tundish requires the performance of periodic maintenance upon and/or the replacement of these parts which cannot be accomplished while the casting operation is ongoing. Similarly, a change in the type of steel being cast requires an interruption in the continuous casting operation. The complete clearing of steel melt from the mold in such cases is undesirable, however, because each new casting start requires time-consuming and expensive preparatory work. Hence, in such cases, the art generally interrupts the continuous casting operation, keeping the end of the first melt in the ingot mold while the necessary maintenance or repairs are performed or the steel type of the melt is changed. Thereafter, a second melt is cast onto the end of the first melt in order to continue the casting operation.

Difficulties sometimes arise in the above regards because the connection between the trailing end of the first melt and the leading end of the second melt must be strong enough to allow the discharge means of the mold which pulls upon the portion of the first melt remaining in the mold to draw the leading end of the second melt through the forming area of the mold. If this connection is not strong enough to withstand the applied tension, the leading end of the second melt may be left behind in the mold. This condition is unsatisfactory, and may be time consuming and expensive to correct. Accordingly, in the sequence casting of steel slabs it has been found (Japanese Patent Application No. 57921/75) that it is advantageous to provide an improved connection between the slabs. In this case, after the melt feed is interrupted, an elongated member having an I-shaped cross section is partially immersed horizontally in the surface of the melt within the mold such that the web connecting the two shorter sections of the "I" is substantially parallel to the direction of travel of the melt and portion of its length extends upwardly from the surface of the melt. The surface of the melt is then covered with cooling material and brought to solidification. Resumption of the casting operation is thereafter accomplished by casting the start of the second melt about the portion of the I-shaped member projecting from the trailing end of the first melt, allowing the start of the second melt to solidify, and withdrawing the trailing end of the first melt from the mold. The locking engagement of the I-shaped member with the trailing end of the first melt and the leading end of the second melt allows the web portion to transmit the extraction force to the leading end of the second melt and draw it through the mold as well. Of course, once the start of the second melt reaches the mold discharge means, the continuous casting operation proceeds as usual.

The foregoing method is not suitable for sequence strip steel casting because an exact positioning of an appropriately smaller I-shaped member in the surface of the melt within the mold is not possible in the narrow confines of the molds used for strip casting. Further, the walls of ingot molds used for strip casting are constantly cooled. This results in a strand shell which rapidly grows inwardly from the mold walls. An I-shaped member would tend to become hung up at the lateral strand shell thereby preventing its horizontal immersion into the melt. Accordingly, the reliable creation of a connection between the first and second melts strong enough to withstand the applied extraction forces cannot be reliably assured by the foregoing method.

SUMMARY OF THE INVENTION

The object of the present invention is to provide a method and apparatus for the sequence casting of steel strip which allows the feed of melt to be intermittently interrupted and provides a secure connection between the end of one melt and the start of the next melt under casting conditions with the required speed.

It is also a objective of the present invention to provide a method and apparatus for the sequence casting of steel strip wherein jamming of the connection between the trailing end one melt and the leading end of the next melt in the mold is avoided.

These and other objectives of the present invention are accomplished in a preferred embodiment thereof by providing steel strip casting equipment including a pouring tube having discharge ports at its end, and a cooled ingot mold having a pair of oppositely disposed broad side walls and a pair of oppositely disposed narrow side walls which together define the mold cavity. The cavity has a pouring area having a generally funnel-shaped vertical cross section in its upper central portion adapted to receive the end of the pouring tube containing the discharge ports. The pouring area tapers inwardly and downwardly from the top of the mold to a level below which is located the forming area of the cavity in which the cross section of the mold approximates the shape of the strip being cast. The pouring area is also bounded within the cavity by flanking areas having cross sectional thicknesses substantially the same as that of the strip being cast. The strip casting equipment also includes mold oscillating means, strip discharge means and elongated anchoring rods adapted for partial longitudinal immersion in the surface of the melt in the flanking portions laterally of the pouring area. Each said rod is contemplated to have a maximum cross sectional thickness smaller than the thickness of the strip being cast, and a maximum cross sectional width smaller than the minimum width of the flanking portion into which it is immersed. Further, each rod is contemplated to be between 800 mm and 1000 mm in length, and to have a cross section which varies over its length to assure rapid and reliable locking engagement with the melts in which is placed. In one form this variable cross section provides at least one peripheral surface adjacent each end of the rod which faces the surface of the melt in the mold when the rod is appropriately positioned.

The method of the invention is accomplished by interrupting the feed of melt through the pouring tube, and partially longitudinally immersing the anchoring rods into the steel melt present in the mold laterally of the pouring area. The surface of the steel melt in the mold is then caused to drop to a level below the pouring area by the continued withdrawal of melt from the mold in the form of steel strip by the strip discharge and the mold oscillating means. The strip discharge means and the mold oscillating means are turned off when the surface of the melt in the mold reaches this level, and the walls of the mold above the surface of the melt then remaining in the mold are coated with a layer of protective material, such as Molykote. Resumption of the casting operation is accomplished by restarting the feed of melt through the pouring tube. The level of the surface of the melt within the mold is allowed to rise above the discharge ports of the pouring tube, at which time casting flux is applied to the surface of the melt. The strip discharge means and the mold oscillation means are then turned on in a manner which allows the surface of the melt to return to its original height therein and the balance between strip discharge speed and melt input rate to be reestablished.

We have found that the anchoring rods of the present invention can be easily introduced and aligned from outside the mold. We have also found that anchoring rods of the preferred length, 800 mm to 1000 mm, should be immersed longitudinally in the melt to a depth of between 250 mm and 400 mm. This depth of penetration of the rods into the melt assures that they will freeze fast in the melt within a few seconds due both to the cooled nature of the mold and their own cold mass relative to the surrounding melt. Further, the method and apparatus of the present invention avoids the problems associated with the horizontal introduction of a connecting element into the surface of the trailing end of the first melt in the narrow confines of a steel strip mold. Still further, the leading end of the second melt lockingly engages the upper ends of the anchoring rods thereby forming a connection between the successive melts which is strong enough to withstand the extraction force applied by the strip discharge means in withdrawing the end of the first melt as strip from the mold. The leading end of the second melt is therefore also drawn through the mold by the end of the first melt until the discharge means can engage it directly thereby restarting the casting operation without the delay and expense of a completely new casting start.

BRIEF DESCRIPTION OF THE DRAWINGS

These and other objects, features, and advantages of the present invention will occur to those skilled in the art by reference to the following detailed description of a preferred embodiment of the invention and to the attached drawings in which.

DETAILED DESCRIPTION OF PREFERRED EMBODIMENT

Figure 1:
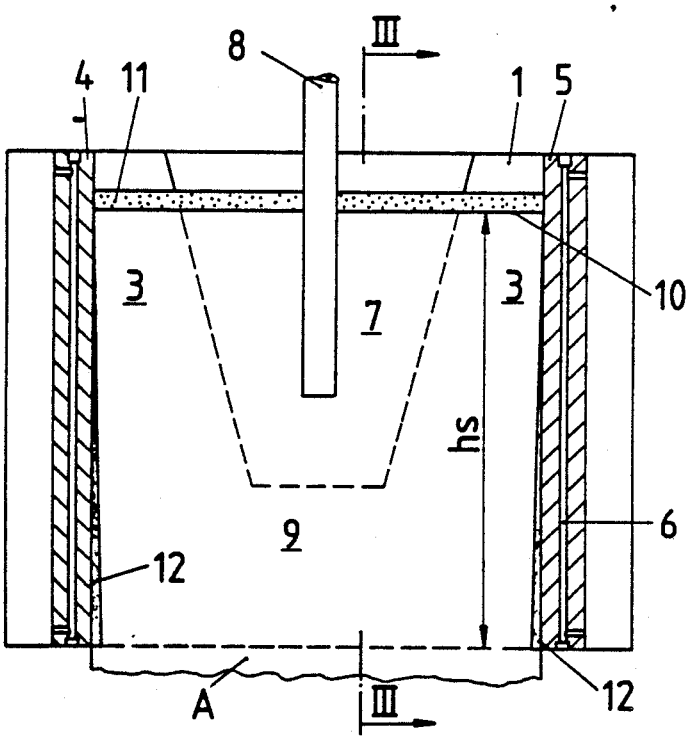
FIG. 1 is a diagrammatic view of a cooled strip casting ingot mold in longitudinal section showing the location of the end of the pouring tube and the maximal height of the surface of the melt therein.
Figure 2:
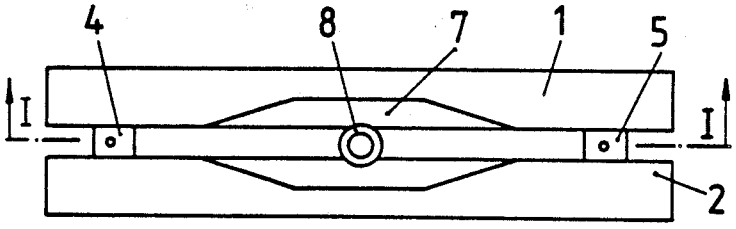
FIG. 2 is a top view of the cooled strip casting mold of FIG. 1.
Figure 3:
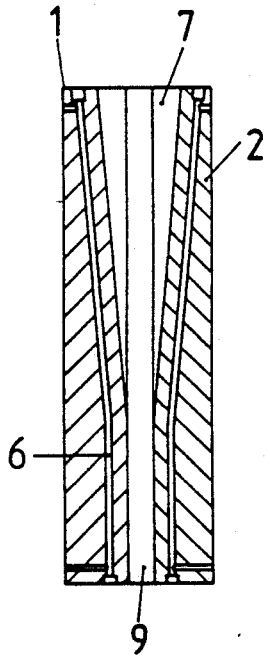
FIG. 3 is a cross sectional view of the cooled strip casting mold of FIG. 1 taken along the line III—III.

Referring now to the drawings, and particularly to FIGS. 1–3, there is diagrammatically shown a strip casting ingot mold in accordance with the present invention. The mold is made up of two oppositely disposed, broad side walls 1 and 2, and two oppositely disposed, narrow side walls 4 and 5, arranged to define the mold cavity. In the upper central portion of the cavity, the broad side walls 1 and 2, define a generally funnel-like pouring area 7. As will be seen from the drawings, pouring area 7 is bordered within the cavity by parallel wall areas 3 on its left and right sides. Forming area 9, in which the cross section of the mold approximates the cross section of the strip being cast, borders the lower portion of pouring area 7. The discharge end of pouring tube 8 extends into the pouring area 7 such that its lateral discharge ports are located between broad side walls 1 and 2. The broad side walls 1 and 2 and the narrow side walls 4 and 5 are cooled by cooling liquid passing through channels 6 therein. It is contemplated that the mold of the present invention will also include mold oscillation means and strip discharge means (not shown) of any conventional and well-known type suitable for use therewith for the facilitation of the passage of the melt through the mold and its discharge therefrom in the form of steel strip.

During the normal continuous casting operation, the ingot mold is filled through the pouring tube 8. The strip discharge speed and the pouring rate are held in balance so that the surface 10 of the melt in the mold is kept at a designated height (hs) which is above the lateral discharge ports of the pouring tube 8 located between the broad side walls 1 and 2 in the pouring area 7. Further, the surface 10 of the melt in the mold is covered with a layer of insulating flux 11. In the area of contact between the flux 11 and the surface 10 of the melt a layer of liquid slag is formed. This slag acts as a lubricant between the ingot mold walls and the strand shell 12 which forms adjacent the mold walls 1, 2, 4, and 5 during the casting operation. This lubrication is aided by the oscillatory movement of the ingot mold provided by the mold oscillation means and acts to prevent the adhesion of the strand shell to the walls of the mold.

Figure 4:
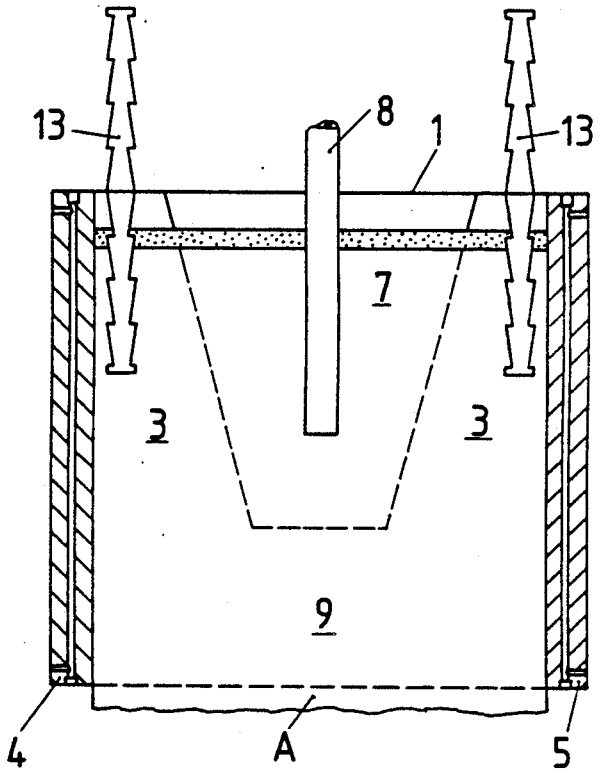
FIG. 4 is a diagrammatic view of a cooled strip casting mold in longitudinal section, as in FIG. 1, showing anchoring rods immersed in the surface of the melt within the mold in accordance with the present invention.
Figure 5:
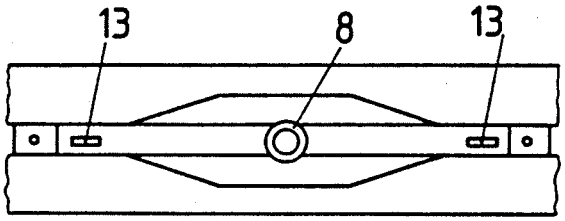
FIG. 5 is a top view of the cooled strip casting mold of FIG. 4.
Figure 7:
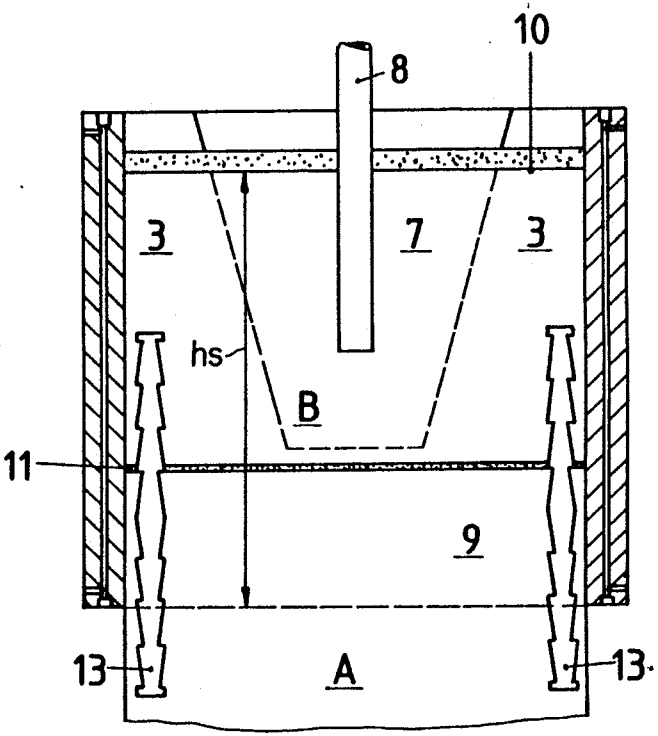
FIG. 7 is a view similar to FIG. 4, showing the strip casting mold, the first and second melts, and the connection therebetween directly after the resumption of the casting operation.
Figure 6:
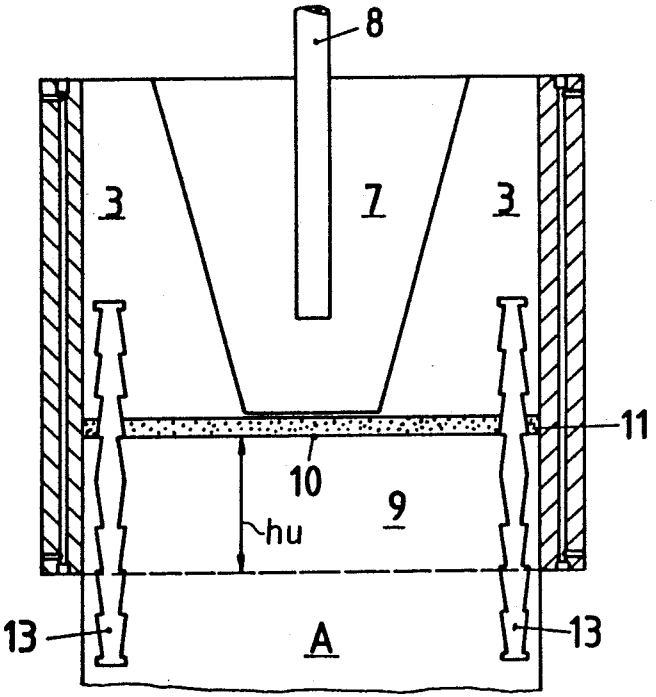
FIG. 6 is a view similar to FIG. 4, showing the surface of the melt in the mold at the level it would have during an interruption of the casting operation in accordance with the present invention.

The apparatus of the invention also includes anchoring rods 13 (seen, for example, in FIGS. 4 and 5) adapted for partial longitudinal immersion into the surface 10 of the melt in the mold. These rods are preferably 800 mm to 1000 mm in length, and preferably have a variable cross section along their length to facilitate their secure locking engagement within the surface of the melt in the mold in the first instance and within the leading end of the next melt introduced into the mold in the second instance, as will be more fully set forth below in connection with the method of this invention. We have found that the provision of at least one peripheral surface facing the surface of the melt adjacent each end of the rod when the rod is immersed in the surface of the melt accomplishes this goal.

The method of interrupting the continuous casting operation for an interval and then resuming continuous casting of the present invention, depicted in FIGS. 4–7, will now be described. The feed of melt through the pouring tube 8 into the pouring area 7 of the mold is stopped. Approximately one third of the length of the anchoring rods 13 then are inserted longitudinally into the surface 10 of the melt. In the preferred case, this means that 250 mm–400 mm of the 800 mm to 1000 mm rods are immersed in the melt. Preferably, the rods are inserted in proximity to the narrow side walls 4 and 5 in the parallel walled areas 3 of the cavity of the mold. At this location, the introduction of the anchoring rods from the outside of the mold and their alignment is easily accomplished. Due to the cold mass of the rods relative to the melt and to the surrounding cooled walls of the mold, the rods freeze fast within the melt in a matter of a few seconds and will thereafter retain their alignment throughout the remainder of the interruption and subsequent continuation of the casting operation.

As soon as the feed of melt is interrupted, the balance between melt input rate and strip output speed is broken. The level of the surface of the melt in the mold starts to move downward because the strip discharge means and the mold oscillation means are still acting to withdraw the melt from the mold in the form of strip without further melt being provided to the pouring area 7. The placement of the anchoring rods described above is a relatively fast operation, and the level of the melt in the mold will not have gone down very far prior to its completion. Thereafter, the level of the surface 10 of the melt present in the mold is allowed to continue going down until it reaches a height (hu) in the mold below the pouring area 7, that is the level of the surface of the melt in the mold is allowed to go down until it is located within the forming area 9. When this level is reached, the strip discharge means and the mold oscillating means are both turned off, leaving the trailing end of the first melt in the forming area 9.

It will be understood that, as the level of the surface of the melt in the mold is allowed to move downwardly as described above, the pouring area 7 narrows from its enlarged funnel-like shape to a thickness substantially the same as the strip being cast. This results in melt from the pouring area 7 being forced into the parallel walled areas 3 of the cavity of the mold and in a rise in the surface level of the melt present in the areas 3 over that which was present when the anchoring rods were introduced and aligned. (Compare FIGS. 4 and 6.) Accordingly, once the surface level of the melt in the mold has been allowed to go down to a level below the pouring area of the cavity of the mold, the anchoring rods will be embedded deeper into the surface of the melt than when they were first inserted. Approximately one-third of the longitudinal length of the anchoring rods will still extend above the surface of the melt in the mold, however, and this is adequate for the completion of the method of the invention.

After the strip discharge and mold oscillation means have been turned off, the walls of the cavity of the mold above the lowered surface of the melt in the mold are coated with a layer of protective material, such as Molykote, to prepare them for the continuation of the casting operation. At this time as well, necessary maintenance may be performed including the replacement of the pouring tube, and/or intermediary containers. Also, the steel type of the melt may be changed at this time, if desired.

The continuation of the casting operation is accomplished as follows. The melt feed through the pouring tube 8 into the pouring area 7 of the cavity of the mold is started. The level of the melt in the mold is allowed to rise surrounding the top parts of the anchoring rods 13. Upon the solidification of this new melt a secure connection to the new strip B being formed will be created. As soon as the discharge ports of the pouring tube are covered by the inflowing second melt, a casting flux is applied to the surface of that melt. The strip discharge means and the mold oscillation means are then restarted in a manner which will bring the melt input and the strip output of the mold into balance with the level of the surface of the melt in the mold at the level it had prior to the interruption of the casting operation. In this start-up phase, the anchoring rods 13 transmit the tension forces applied to the trailing end of the first melt (strip part A in the drawing) by the strip discharge means and the mold oscillation means to the leading end of the second melt (strip part B in the drawing) until this leading end of the second melt reaches, and can be engaged directly by, the strip discharge means.

Having thus described a preferred embodiment of the method and apparatus of the present invention, numerous modifications, improvements, alterations, and the like, will occur to those skilled in the art. It is, accordingly, our intent that the foregoing specification be understood as illustrative only, and that the scope of our invention be limited only by the attached claims.

We claim:

1. A method for sequence casting steel strip comprising the steps of:

(1) providing a pouring tube having discharge ports, strip discharge means, mold oscillation means, and a cooled ingot mold having a pair of substantially parallel broad side walls and a pair of substantially parallel narrow side walls defining a mold cavity including an upper portion having an enlarged, generally funnel-shaped, central pouring area tapering inwardly and downwardly from the top of said mold flanked on opposite sides by lateral areas having cross-sectional thicknesses substantially the same as the strip being cast, and a lower portion having cross-sectional dimensions approximately the same as the strip being cast, wherein under normal operating conditions a steel melt is fed through the discharge ports of the pouring tube into the pouring area at a location below the normal operational level of the melt, and thereafter is removed from the mold in the form of steel strip by the mold oscillation means and strip discharge mans;

(b) interrupting the feed of steel melt while continuing the operation of the mold oscillating means and the strip discharge mans;

(c) providing at least two elongated anchoring rods;

(d) partially immersing at least one anchoring rod longitudinally into the melt contained in each of said lateral areas of the mold cavity immediately after interrupting the feed of steel melt;

(e) turning off the strip discharge and mold oscillation means when the level of the melt in the mold is located within the lower portion of the mold;

(f) restarting the feed of melt after the desired interruption interval;

(g) applying casting flux to the surface of the melt within the mold when it has risen above the discharge ports of the pouring tube; and, (i) turning on the strip discharge and mold oscillation means such that the level of the melt within the mold is reestablished and maintained at its normal operational level, whereby a secure connection between the trailing end of one melt and the leading end of the next melt is created without jamming the mold.

2. The method of claim 1 further characterized by coating the walls of the cavity of the ingot mold above the level of the melt with layer of protective material after the strip discharge and mold oscillating means are turned off.

3. The method of claim 1 further characterized in that said anchoring rods vary in cross section over their lengths.

4. The method of claim 1 further characterized in that said anchoring rods have a length between about 800 mm and 1000 mm, and are immersed in the melt in said lateral areas to a depth between about 250 mm and 400 mm.

5. The method of claim 1 further comprising selecting said anchoring rods such that the longitudinal length of each rod is substantially greater than the longitudinal elongation of the melt in the mold as the level of the melt in the mold drops from its normal operational level into the lower portion of the cavity of the mold.

6. The method of claim 5 further comprising selecting the length of each said rod to be at least three times said longitudinal elongation of the melt in said mold.

7. The method of claim 6 wherein said partial immersion of said anchoring rods comprises immersing approximately one-third of their length longitudinally into the melt in said lateral areas of the mold.

* * * * *

UNITED STATES PATENT AND TRADEMARK OFFICE

CERTIFICATE OF CORRECTION

PATENT NO. : 4,969,506

DATED : November 13, 1990

INVENTOR(S) : Kolakowski et al.

It is certified that error appears in the above-identified patent and that said Letters Patent is hereby corrected as shown below:

On the title page, under the ABSTRACT, "7 Claims, 2 Drawing Sheets" should read --7 Claims, 3 Drawing Sheets--.

Column 6, line 29, delete "(1)" and substitute -- (a) --.

Column 6, line 48, delete "mans" and substitute -- means --.

Column 6, line 51, delete "mans" and substitute -- means --.

Signed and Sealed this

Twenty-eighth Day of July, 1992

*Attest:*

DOUGLAS B. COMER

*Attesting Officer*

*Acting Commissioner of Patents and Trademarks*